United States Patent [19]

Yamasaki

[11] Patent Number: 4,766,977

[45] Date of Patent: Aug. 30, 1988

[54] LOAD DETECTING APPARATUS FOR ELEVATOR

[75] Inventor: Shinji Yamasaki, Inazawa, Japan

[73] Assignee: Mitsubishi Denki Kabushiki Kaisha, Japan

[21] Appl. No.: 918,266

[22] Filed: Oct. 14, 1986

[30] Foreign Application Priority Data

Oct. 15, 1985 [JP] Japan ..... 60-229055

[51] Int. Cl.[4] ..... B66B 11/08

[52] U.S. Cl. ..... 187/20; 187/28; 187/106

[58] Field of Search ..... 187/20, 28, 22, 106, 187/105; 254/275; 73/862.36, 862.34

[56] References Cited

U.S. PATENT DOCUMENTS

| | | | |
|---|---|---|---|
| 3,323,606 | 6/1967 | Bruns et al. | 187/28 X |
| 4,479,390 | 10/1984 | Meixner | 73/862.36 |
| 4,506,554 | 3/1985 | Blomkvist et al. | 73/862.36 |
| 4,569,423 | 2/1986 | Hirano | 187/20 |

FOREIGN PATENT DOCUMENTS

| | | | |
|---|---|---|---|
| 1202453 | 10/1965 | Fed. Rep. of Germany | 254/275 |
| 2752080 | 6/1978 | Fed. Rep. of Germany | 73/862.36 |
| 44841 | 3/1985 | Japan | 73/862.36 |
| 838448 | 6/1981 | U.S.S.R. | 73/862.36 |
| 1232966 | 5/1986 | U.S.S.R. | 73/862.34 |

*Primary Examiner*—Joseph J. Rolla
*Assistant Examiner*—Nils E. Pedersen
*Attorney, Agent, or Firm*—Leydig, Voit & Mayer

[57] ABSTRACT

A load detecting apparatus for an elevator for detecting a torsion generated on a rotary shaft of a traction sheave for driving an elevator cage and a counterweight in accordance with a difference between the load of the cage and the counterweight, so that the apparatus is capable of detecting with precision an unbalanced load, even when the passengers are standing on one side of the cage platform.

8 Claims, 5 Drawing Sheets

LOAD DETECTING APPARATUS FOR ELEVATOR

BACKGROUND OF THE INVENTION

This invention relates to a load detecting apparatus for an elevator for detecting a difference between load of an elevator cage and a counterweight by measuring the shaft torque of a hoisting device.

In an elevator system, a load torque acting on a hoisting electric motor varies in accordance with the number of passengers in an elevator cage. The variation of the load torque causes a sudden high speed or low speed when the elevator cage is started and decelerated, resulting in the reduced comfort of the passengers riding in the cage as well as requiring more time for the cage to attain its set speed. In order to deal with such problems, there is provided a measuring device comprising elastic members and a microswitch under an elevator cage platform. When passengers get into the cage, the elastic members are bent and the bending of the elastic members is detected by a microswitch for determining a load value of the cage. A hoisting electric motor is controlled in accordance with the determined load value so that the cage is smoothly accelerated and decelerated.

FIGS. 1 and 2 illustrate one example of an elevator system using a conventional load detecting apparatus which is set forth in Japanese Utility Model Laid Open No. 60-2138. The elevator system comprises a hoistway 1, a machine room 2 provided above the hoistway 1 having a floor 2*a*, through openings 2*b* provided in the floor 2*a*, I-shaped support beams 3 disposed on the floor 2*a* in the corresponding relationship with respect to the side walls of the hoistway 1, machine base 4 supported respectively at both ends thereof by the support beams 3, a base member 5 disposed on the machine bases 4 through anti-vibration rubber 6, a traction sheave 7 whose rotary shaft is disposed in the cross direction with respect to the base member 5 and disposed substantially on the center portion of the base member 5, a deflector sheave 8 supported by a deflector beam 9 which is fixed below the base member 5 and disposed in the corresponding relationship with respect to the traction sheave 7, a bracket 10 secured to the base member 5 for supporting one end of the rotary shaft of the traction sheave 7, a reduction gear composed principally of parallel shaft gears and secured to the base member 5 for controlling the traction sheave 7, an electric motor 12 for driving the reduction gear 11, a cinder concrete 13 disposed on the floor 2*a*, a hoisting rope 14 wound over the traction sheave 7 and the deflector sheave 8 and having both ends thereof suspended into the hoistway 1 through the openings 2*b*, a counterweight 16 fixed to one end of the hoisting rope 14, and an elevator cage 15 fixed to the other end of the hoisting rope 14, comprising a cage frame 15*a*, a cab 15*b*, elastic members 15*c* disposed between the cage frame 15*a* and the cab 15*b* for supporting the cage platform 15*d*, a microswitch 15*e* for detecting the amount of the bending of the elastic members 15*c* when passengers get into the cage 15, the detected amount being transmitted to the machine room 2 through a cable (not shown), and a counterweight 16.

In the elevator system as stated above, when the load of the cage 15 is detected by means of the microswitch 15*e*, the difference between the load of the cage and the counterweight (hereinafter referred to as unbalanced load) is calculated. According to the calculated unbalanced load, the proper torque to be applied to the traction sheave 7 and also the electric motor 12 is determined, and the elevator cage 15 is operated accordingly.

As has been described above, the conventional load detecting apparatus for an elevator is composed of a plurality of elastic members and a microswitch. However, when the passengers crowd into one side of the cage and just above one of the elastic members, the amount of bending of the elastic member may be excessively detected when compared with the real load. Namely, if the passengers were standing evenly on the cage platform, the microswitch would not be activated. Furthermore, when the passengers crowd on one side of the cage platform which is relatively far from the microswitch, the amount of bending of the elastic member is detected as being less than the real load by the microswitch. In other words, the load of the cage may be erroneously detected. Besides, a relatively long cable is required from the microswitch to the control board, which may eventually result in a broken cable so that it becomes useless.

SUMMARY OF THE INVENTION

Accordingly, an object of the present invention is to provide a load detecting apparatus for an elevator capable of correctly detecting the load in a cage, even if the passengers crowd to one side of the cage platform.

According to the present invention, the load detecting apparatus for an elevator is adapted to detect a torsion generated on a rotary shaft of a traction sheave for driving an elevator cage and a counterweight in accordance with a difference between the load of the cage and the counterweight.

According to the present invention, when a difference between the loads of the cage and the counterweight occurs, a torsion is produced on the rotary shaft of the traction sheave due to this difference of the loads. The load detecting apparatus is adapted to detect an unbalanced torque generated on the rotary shaft of the traction sheave in accordance with the difference of the loads by detecting this torsion. Thus, the apparatus is capable of detecting with precision the unbalanced torque, even when the passengers are standing on one side of the cage platform.

BRIEF DESCRIPTION OF THE DRAWINGS

The present invention will become more readily apparent from the following detailed description of the preferred embodiment of the invention taken in conjunction with the accompanying drawings, in which:

FIG. 3 is a front view, partly in section, of a hoisting device of the elevator system;

FIG. 4 is an enlarged cross sectional view of a principal portion of the invention;

FIG. 5 is a circuit diagram of a detecting circuit;

FIG. 6 is an explanatory graph of magnetic flux intensity and magnetic field.

DESCRIPTION OF THE PREFERRED EMBODIMENT

Figure 1:
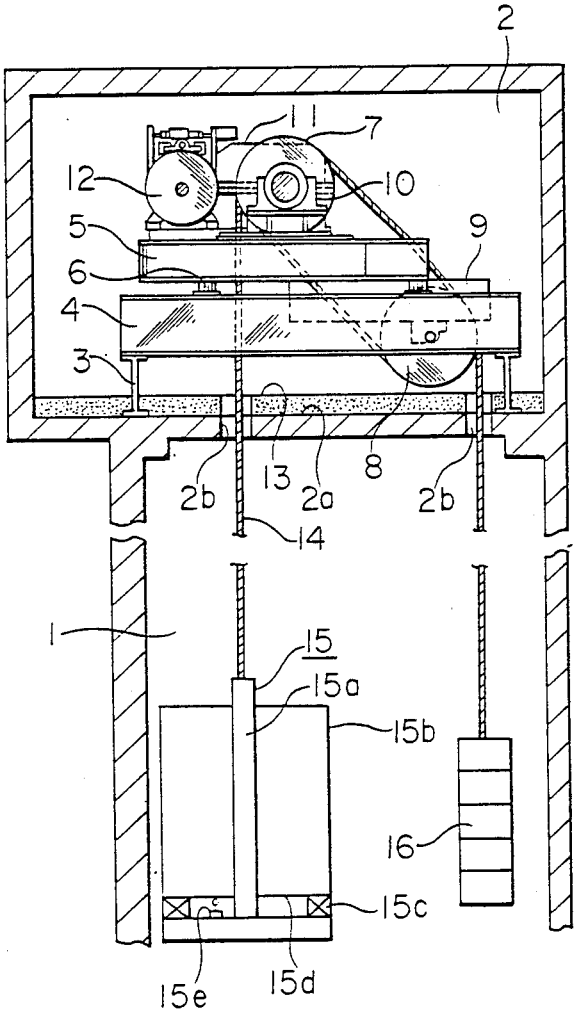
FIG. 1 PRIOR ART
FIG. 1 is a sectional side view of an elevator system using a conventional load detecting apparatus.
Figure 2:
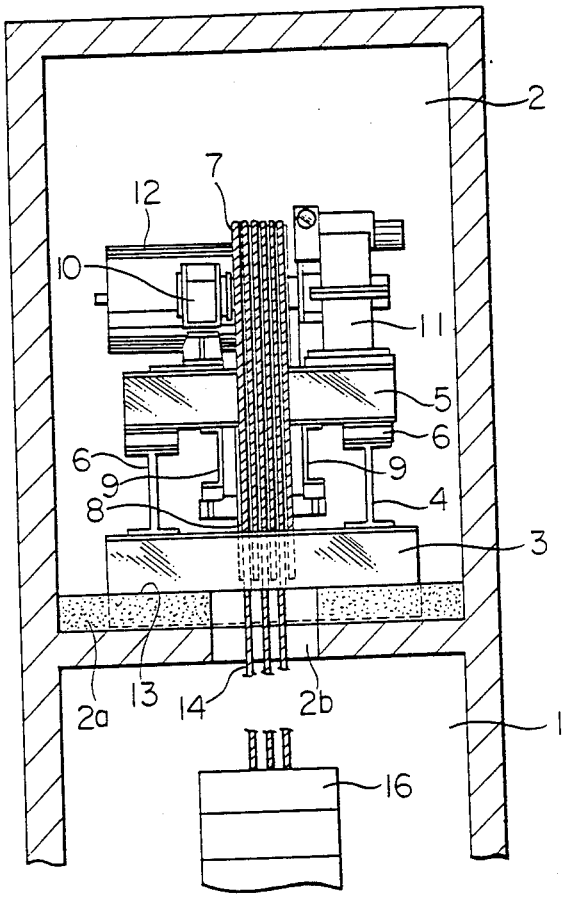
FIG. 2 PRIOR ART
FIG. 2 is a sectional side view of the elevator system illustrating a hoisting device in a hoistway enclosure.

FIGS. 3 to 6 illustrate a load detecting apparatus for an elevator according to one embodiment of the present invention. The apparatus shown in FIGS. 3 to 6 is different from the apparatus shown in FIGS. 1 and 2 in that the former includes a load detecting apparatus provided on a rotary shaft of a traction sheave of a hoisting device. In other respects, the structure of the present invention is the same as that of the conventional elevator system illustrated in FIGS. 1 and 2.

Figure 3:
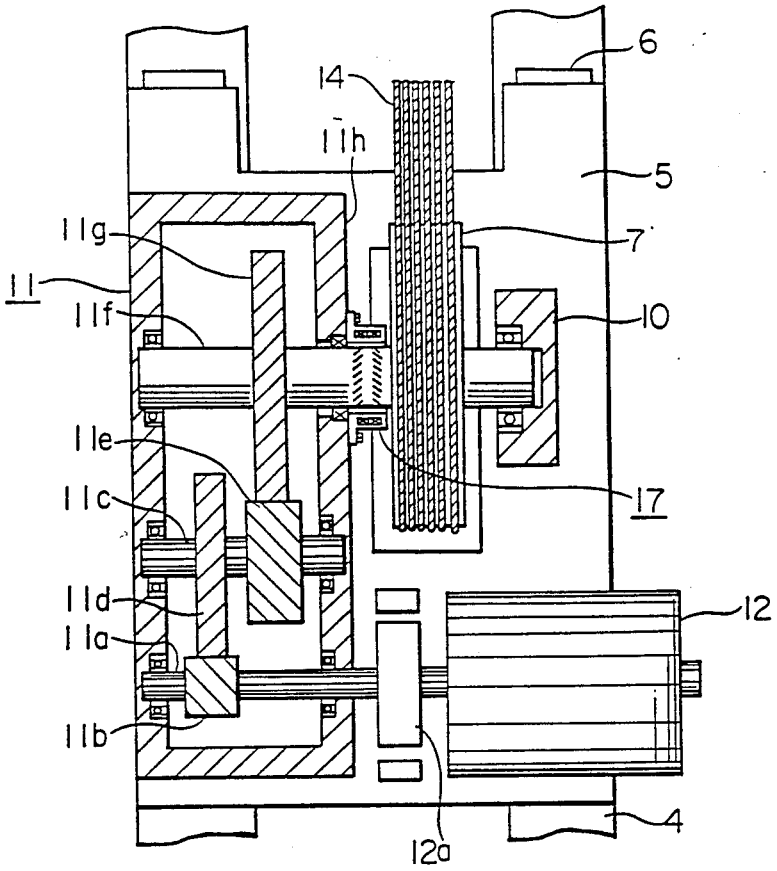
FIGS. 3 to 6 illustrate a load detecting apparatus for an elevator according to one embodiment of the present invention.

Referring now to FIG. 3, the hoisting device comprises a base member 5, anti-vibration rubber 6, a traction sheave 7, a bracket 10, a reduction gear 11, an electric motor 12 having a control device 12*a* secured on the rotary shaft of the motor 12 for controlling an input shaft 11*a*, a hoisting rope 14 and a detecting apparatus 17. The reduction gear 11 comprises the input shaft 11*a*, a first gear 11*b* secured on the input shaft 11*a*, a second shaft 11*c*, a second gear 11*d* secured on the second shaft 11*c* for engaging with the first gear 11*b*, a third gear 11*e* also secured on the second shaft 11*c*, an output shaft 11*f* secured at one end portion thereof to the traction sheave 7, a fourth gear 11*g* secured on the output shaft 11*f* for engaging with the third gear 11*e* and a gear box 11*h*. The detecting apparatus 17 is adapted to detect a torsion generated on the output shaft 11*f* due to an unbalanced load torque acting on the traction sheave 7.

Figure 4:
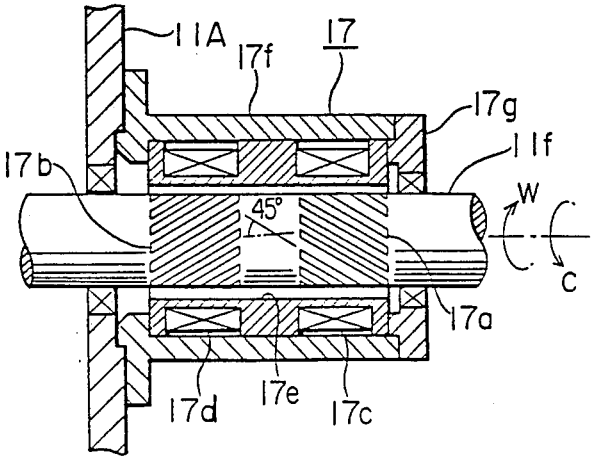

Referring now to FIG. 4, the detecting apparatus 17 comprises a first magnetized layer (17*a*) and a second magnetized layer (17*b*). The first magnetized layer (17*a*) comprises a plurality of magneto-strictive members which are fixed at an angle of 45° with respect to the axis of the output shaft 11*f* on the circumferencial outer surface of the output shaft 11*f*, the plurality of magneto-strictive members being arranged so as to be spiral at predetermined intervals on the peripheral surface of the output shaft 11*f*. The second magnetized layer 17*b* being disposed in the same manner as in the first layer 17*a*, but in a symmetrical opposite relationship with respect to the spirating direction of the first magnetized layers 17*a*. The detecting apparatus 17 further comprises a first annular detecting coil 17*c* and a second annular detecting coil 17*d*, each being disposed in a corresponding relationship with the respective magnetized layers 17*a* and 17*b*, a hollow cylindrical member 17*e* made of a non-magnetic substance having the first and second detection coils 17*c*, 17*d* supported in the hollow portion thereof and the output shaft 11*f* passing through the center hole thereof, a supporting member 17*f* secured to the gear box 11*h* for receiving the cylindrical member 17*e*, and an end member 17*g* mounted on an open end of the cylindrical member 17*e*.

Figure 5:
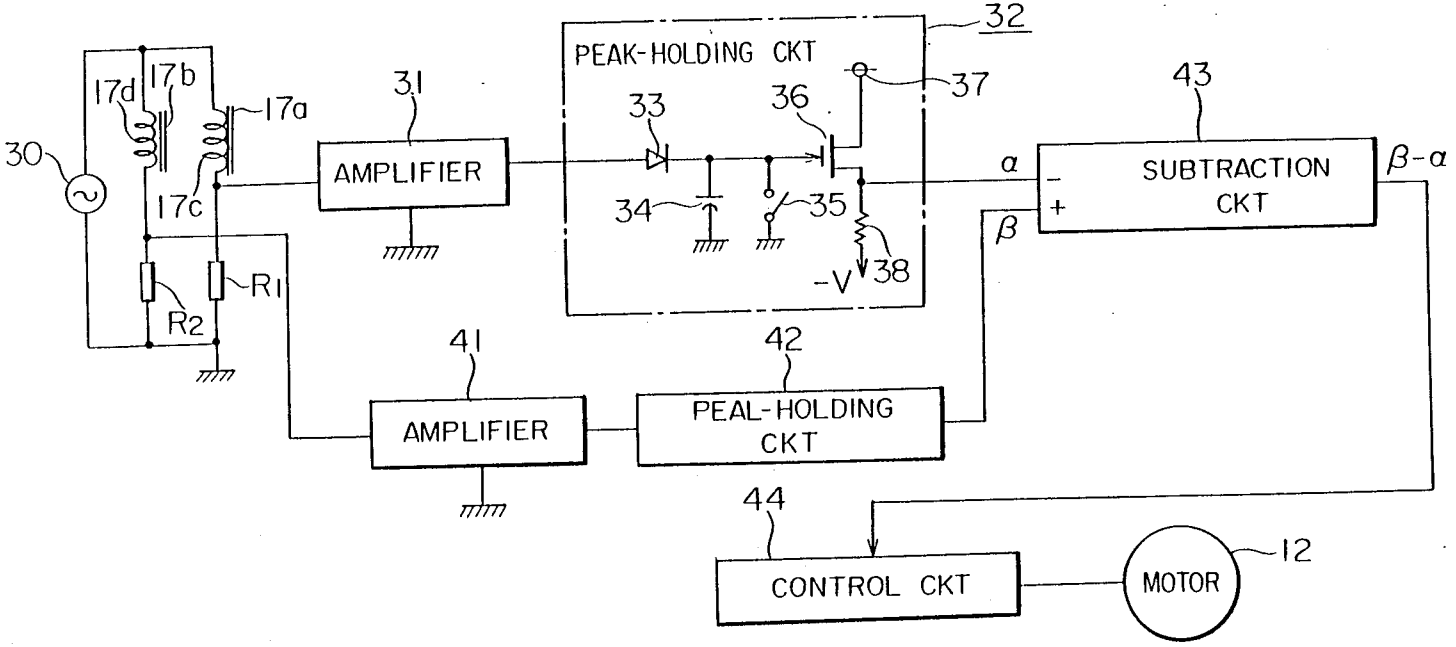

Referring now to FIG. 5, reference numeral 30 designates an AC power source, symbol marks R1 and R2 designate resistors, reference numeral 31 designates an amplifier for amplifying the voltage across the resistor R1, reference numeral 41 designates an amplifier for amplifying the voltage across the resistor R2, reference numeral 32 designates a peak-holding circuit comprising a diode 33, a capacitor 34 for accumulating an output of the diode 33, a contact 35 which is opened before the elevator cage is operated and closed during the time that the elevator cage is being operated, a field effect transistor (hereinafter referred to as FET) 36, a plus source 37 and a resistor 38 connected to a minus source −V. The peak-holding circuit 42 has the same structure as the peak-holding circuit 32. The detecting circuit further includes a subtraction circuit for subtracting the outputs from the two peak-holding circuits 32, 42 and for outputting unbalanced load signals having value proportional to the torque values acting on the output shaft 11*f*, the value being "plus" when the cage is heavier than the counterweight and "minus" when the cage is lighter than the counterweight.

Next, the operation of the load detecting apparatus for an elevator will be described.

During the time that the elevator cage is being held in a stopped position, the control device is operated for maintaining the input shaft 11*a* stationary.

(I) First, suppose that the cage 15 is heavier than the counterweight 16 when the cage 15 is in a stopped position. A torsion force is generated on the output shaft 11*f* in the direction of the arrow C as shown in FIG. 4, so that a tension force occurs on the first magnetized layer 17*a* while a compression force occurs on the second magnetized layer 17*b*.

Figure 6:
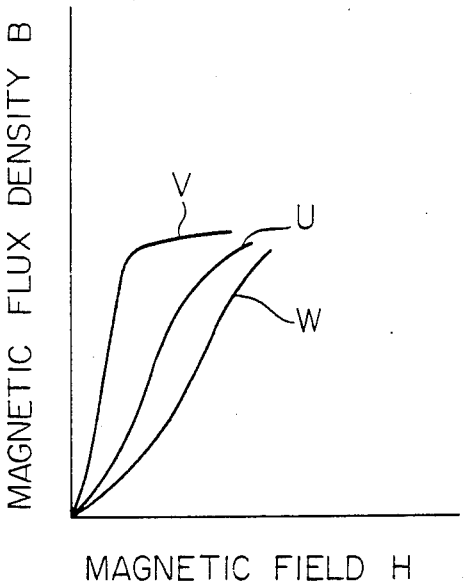

The first and second magnetic layers 17*a*, 17*b* have characteristics as shown in FIG. 6. Namely, when no force exists on the output shaft 11*f*, the B-H curve represents a curve as shown by U. When a tension force exists on the output shaft 11*f*, an inclination of the curve to become more vertical in accordance with the amount of the tension force arrives as shown by a curve V. When a compression force is applied on the output shaft 11*f*, the inclination of the curve to become more horizontal in accordance with the amount of the compression force arrives as shown by the curve W.

Referring to FIG. 5, when the first detecting coil is energized by an AC electric power source 30, the relation of the inductance L1 to the magnetic flux density (B) and the magnetic field (H) is as follows:

$$L1 \propto \frac{\text{Magnetic flux density } (B)}{\text{Magnetic field } (H)} \qquad 1$$

Accordingly, the following is given:

when a tension force exists on the shaft, L1 becomes large while, when a compression force exists on the shaft, L1 becomes small. (2)

The same relation as (2) is given also for the second detecting coil 17*d*

Accordingly, the following relation is given:

A current from the first detecting coil 17*c* < a current from the second detecting coil 17*d* (3)

and

Voltage of the resistor R1 < voltage of the resistor R2 (4)

The voltage developed across the resistor R1 is amplified by the amplifier circuit 31 and half-wave rectified through the diode 33 in the peak-holding circuit 32 to be accumulated in the capacitor 34. As the contact 35 is opened just before the elevator cage 15 is brought into operation, the capacitor 34 generates a peak voltage. A peak voltage corresponding to the peak voltage generated in the capacitor 34 is developed in the resistor 38 through FET 36. Thus developed voltage $\alpha$ is inputted to a minus terminal (−) of the subtraction circuit 43.

On the other hand, the voltage developed across the resistor R2 is handled in the same manner as stated above. The developed voltage $\beta$ in the peak-holding circuit 42 is inputted to a plus terminal (+) of the subtraction circuit 43. The subtraction circuit 43 outputs the subtracted voltage $(\beta-\alpha)$. This output $(\beta-\alpha)$ represents an unbalanced load on the output shaft 11*f*. Prior to the starting of the electric motor 12 is a torque proportional to this unbalanced load must be produced, so that the proper signals may be outputted by the control circuit 44.

(II) Then, suppose that the counterweight 16 is heavier than the elevator cage 15 when the cage 15 is in a stopped position. A torsion force is generated on the output shaft 11*f* in the direction of the arrow W as shown in FIG. 4. Accordingly, a compression force is applied on the first magnetized layer 17*a*, while a tension force is applied on the second magnetized layer 17*b*.

As a result, the following relation is given:

$$\text{Voltage of the resistor R1} > \text{voltage of the resistor R2} \quad (5)$$

The output from the subtraction circuit 43 is therefore negative. In other words, the torque in the motor 12 is generated in the opposite direction to the first case I, and becomes appropriate with respect to the unbalanced load due to the fact that the cage is heavier than the counterweight.

(III) Further, in case that the weight of the cage is equal to the weight of the counterweight, no torsion is generated on the output shaft 11*f*.

Accordingly, the following relation is given:

$$\text{Voltage of the resistor R1} = \text{voltage of the resistor R2} \quad (6)$$

The respective outputs $\alpha$ and $\beta$ from the peak-holding circuits 32, 42 become of the same value, so that no output is provided from the subtraction circuit 43. In other words, no torque to cancel out the unbalanced load is provided from the electric motor 12.

According to the embodiment of the present invention, the load detecting apparatus for an elevator is adapted to detect directly the torque in accordance with the unbalanced load by way of the torsion imposed on the output shaft 11*f* of the hoisting device, so that, even if the passenger crowd to one side of the elevator cage, the unbalanced torque is detected with precision. The hoisting device and the control board are usually close to each other, thereby making it possible to reduce the length of the cable from the detecting coils 17*c*, 17*d*. Further, the unbalanced load can be continuously determined in comparison with the case where the unbalanced load is detected by the microswitch, thereby making it possible to control the cage smoothly. According to the above embodiment, the magnetized layers 17*a*, 17*b* are disposed at an angle of 45° with respect to the axis of the output shaft 11*f* such that they respond to any torsion present on the output shaft. Furthermore, the magnetized layers 17*a*, 17*b* are disposed in symmetrically opposed directions to each other, so that the sensitivity to torsion is improved, since one layer is strained when the other layer is compressed.

However, the unbalanced load on the output shaft 11*f* and the output from the subtraction circuit 43 are not always proportional to each other. The output from the subtraction circuit 43 may be inputted to a compensation circuit (not shown) to correct so as to provide a proportional corrected value which may then be inputted to the control circuit 44 shown in FIG. 5.

As has been described above, according to the present invention, the load detecting apparatus is adapted to detect a torsion existing on the output shaft of the traction sheave for determining an unbalanced load which is acting on the traction sheave, when any difference in load between the cage and the counterweight exists, thereby making it possible to correctly detect the unbalanced torque, even if the passenger crowd to one side of the cage platform.

What is claimed is:

1. A load detecting apparatus for an elevator comprising:

a traction sheave having a hoisting rope wound thereon, one end of the rope being fixed to an elevator cage and the other being attached to a counterweight so that the elevator cage and counterweight are at least partly balanced;

a rotary shaft disposed between said traction sheave and a controller which controls said traction sheave for transmitting a controlled force to said traction sheave; and torsion detecting means responsive to the torsion applied to said rotary shaft while the cage is at rest for detecting the degree and direction of any inbalance between the cage and counterweight acting on said hoisting rope.

2. A load detecting apparatus for an elevator as defined in claim 1, wherein said torsion detecting means comprises;

a pair of magnetized layers, each comprising a plurality of magneto-strictive members secured to said rotary shaft, a pair of detection coils, each disposed so as to surround one of said magnetized layers and a detection circuit for detecting the inductance of said detection coils.

3. A load detecting apparatus for an elevator as defined in claim 2 wherein said magnetized layers each comprise first magneto-strictive members disposed at an angle of 45° with respect to an axis of said rotary shaft and second magneto-strictive members disposed at an angle of 45° with respect to said axis in the direction opposed to said first magneto-strictive members.

4. A load detecting apparatus for an elevator as defined in claim 3 wherein each of said magnetized layers further comprises a plurality of rows of magneto-strictive members disposed on the circumferential surface of said rotary shaft.

5. A load detecting apparatus for an elevator as defined in claim 4 wherein said detection coils each comprise a first detection coil and a second detection coil disposed respectively in an corresponding relationship with both of said coils and being disposed so as to surround said respective rows of magneto-strictive members arranged on the circumferencial surface of said rotary shaft.

6. A load detecting apparatus for an elevator as defined in claim 5 wherein said first and second detection coils are retained in a cylindrical member of nonmagnetic material, said cylindrical member being secured to a reduction gear supporting said rotary shaft through supporting means.

7. A load detecting apparatus for an elevator as defined in claim 5 wherein said detection circuit comprises:

a first resistor and a second resistor connected respectively to said first and second detection coils;

first amplifying means and second amplifying means for amplifying respectively the voltage across said first and second resistors;

first and second peak-holding means in which the output voltages amplified by said first and second amplifying means are input, which hold a peak value of said output voltages, and which provide outputs according to said peak value; and a subtraction circuit, the inputs of which are connected to the output of said first and second peak-holding circuit for calculating the difference between said outputs and outputting a signal representative of the difference.

8. A load detecting apparatus for an elevator as defined in claim 7 wherein said first and second peak-holding circuit hold said peak value just before the elevator cage is brought into operation.

* * * * *